US012241645B2

(12) United States Patent
Li et al.

(10) Patent No.: US 12,241,645 B2
(45) Date of Patent: Mar. 4, 2025

(54) METHOD AND DEVICE FOR CONTROLLING AIR CONDITIONING AND COMPUTER READABLE STORAGE MEDIUM

(71) Applicants: Shanghai Meicon Intelligent Construction Co., Ltd., Shanghai (CN); GD Midea Heating & Ventilating Equipment Co., Ltd., Foshan (CN)

(72) Inventors: Yuanyang Li, Shanghai (CN); Jie Fei, Shanghai (CN); Jiongpei Hu, Shanghai (CN); Yide Qiu, Shanghai (CN); Manning Huang, Shanghai (CN); Jie Yan, Shanghai (CN); Zhecan Lin, Shanghai (CN)

(73) Assignees: SHANGHAI MEICON INTELLIGENT CONSTRUCTION CO., LTD., Shanghai (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 387 days.

(21) Appl. No.: 17/701,453

(22) Filed: Mar. 22, 2022

(65) Prior Publication Data

US 2022/0214067 A1 Jul. 7, 2022

Related U.S. Application Data

(63) Continuation of application No. PCT/CN2020/077471, filed on Mar. 2, 2020.

(30) Foreign Application Priority Data

Oct. 16, 2019 (CN) ..... 201910985818.6

(51) Int. Cl.
*F24F 11/46* (2018.01)
*F24F 11/64* (2018.01)
(Continued)

(52) U.S. Cl.
CPC ..... *F24F 11/46* (2018.01); *F24F 11/64* (2018.01); *F24F 11/84* (2018.01); *F24F 2140/50* (2018.01)

(58) Field of Classification Search
CPC .. F24F 11/46; F24F 11/64; F24F 11/84; F24F 2140/50; F24F 11/62; F24F 11/47
See application file for complete search history.

(56) References Cited

U.S. PATENT DOCUMENTS

2011/0144948 A1* 6/2011 Nishino ..... F24F 11/38 702/183
2011/0257794 A1* 10/2011 Nishino ..... F24F 11/63 700/277
(Continued)

FOREIGN PATENT DOCUMENTS

CN 101163926 A 4/2008
CN 101424436 A 5/2009
(Continued)

OTHER PUBLICATIONS

Guangdong Midea HVAC Equipment Co., Ltd., International Search Report, International Search Report, PCT/CN2020/077471, Jun. 29, 2020, 12 pgs.
(Continued)

*Primary Examiner* — Kamini S Shah
*Assistant Examiner* — Mohammed Shafayet
(74) *Attorney, Agent, or Firm* — Morgan, Lewis & Bockius LLP

(57) ABSTRACT

A method and device for controlling an air conditioner, and a computer readable storage medium. The method for con-
(Continued)

trolling an air conditioner includes: upon detecting a power-on or power-off command corresponding to an internal unit of a central air conditioner, acquiring a current predicted load of the central air conditioner; determining whether the predicted load meets an external unit change condition; and if so, adjusting an operating state of an external unit of the central air conditioner on the basis of the predicted load.

11 Claims, 1 Drawing Sheet

(51) Int. Cl.
*F24F 11/84* (2018.01)
*F24F 140/50* (2018.01)

(56) References Cited

U.S. PATENT DOCUMENTS

| | | | | |
|---|---|---|---|---|
| 2015/0292514 | A1* | 10/2015 | Tateishi | F28F 27/003 416/33 |
| 2020/0080742 | A1* | 3/2020 | Okamoto | G05B 17/02 |
| 2022/0090813 | A1* | 3/2022 | Fujita | F24F 11/74 |
| 2022/0146133 | A1* | 5/2022 | Miyake | F24F 11/62 |
| 2022/0307713 | A1* | 9/2022 | Zhuo | F24F 11/42 |

FOREIGN PATENT DOCUMENTS

| | | | |
|---|---|---|---|
| CN | 101650552 | A | 2/2010 |
| CN | 102353122 | A | 2/2012 |
| CN | 102538144 | A | 7/2012 |
| CN | 107763792 | A | 3/2018 |
| CN | 107860103 | A | 3/2018 |
| CN | 108332346 | A | 7/2018 |
| CN | 108716756 | A | 10/2018 |
| CN | 108800431 | A | 11/2018 |
| CN | 108917103 | A | 11/2018 |
| CN | 108954713 | A | 12/2018 |
| CN | 109163427 | A | 1/2019 |
| CN | 109974218 | A | 7/2019 |
| CN | 110686366 | A | 1/2020 |
| JP | 2004211973 | A | 7/2004 |
| JP | 2014031949 | A | 2/2014 |
| JP | 2014074509 | A | 4/2014 |

OTHER PUBLICATIONS

Guangdong Meidi Heating Ventilation Equipment Co., Ltd., First Office Action, CN Application No. 201910985818.6, May 29, 2020, 6 pgs.
Guangdong Midea HVAC Equipment Co., Ltd., Notice of Allowance, Application No. 201910985818.6, Jan. 8, 2021, 6 pgs.
Midea Group Co., Ltd., Extended European Search Report and Supplementary Search Report, EP20877598.1, Aug. 10, 2022, 12 pgs.
Midea Group Co., Ltd., Written Opinion, PCT/CN2020/077471, Jun. 29, 2020, 6 pgs.
Midea Group Co., Ltd., IPRP, PCT/CN2020/077471, Apr. 19, 2022, 7 pgs.

* cited by examiner

METHOD AND DEVICE FOR CONTROLLING AIR CONDITIONING AND COMPUTER READABLE STORAGE MEDIUM

CROSS-REFERENCE TO RELATED APPLICATION

This application is a continuation of PCT International Application No. PCT/CN2020/077471, filed Mar. 2, 2020, the entire content of which is incorporated herein by reference, which claims the benefit of the Chinese Patent Application No. 201910985818.6, filed on Oct. 16, 2019, with China National Intellectual Property Administration, the entire contents of which are incorporated herein by reference.

FIELD

The present disclosure relates to the field of the air conditioner technology, in particular to an air conditioner control method and device, and a computer readable storage medium.

BACKGROUND

At present, a central air conditioner is generally in a low level for its operation and management, which mainly relies on a manual control method by management personnel. Even with an automatic control system, it is only started to operate according to manual click and startup, but is incapable of dynamic adjustment according to changes of an environmental parameter and load in a self-adaptive way, thus being unable to guarantee energy efficiency of the system. At the time of causing startup of the central air conditioner or switching hosts during intermediate operation, it is required to perform subsequent adjustment and switching operation manually and slowly according to system feedback, which usually takes more than 1 hour, with an expense of comfortability and systematic energy waste caused.

For example, for some scenarios withe lower load demand, such as overtime in office buildings or administration buildings, restaurants or movie theaters that open overnight in commercial buildings; shifts for some production lines that are added in accordance with market demand in factories, the cooling capacity under such a lower load demand is usually about 10% of the cooling capacity required during the normal working hours. However, the lower load demand sometimes being higher or lower than usual often causes user complaints due to poor property management. When the property management cannot accurately turn on the corresponding host according to the demand, the host in the central air conditioner will run inefficiently, resulting in more power consumption of the central air conditioner, especially when those overtime populations or owners who consume less power is charged with an expensive fee for use of the air conditioner.

The above content only assists to understand the technical solutions of present disclosure, but does not mean to acknowledge the above content as prior art.

SUMMARY

The main objective of the present disclosure is to provide an air conditioner control method and device, and a computer readable storage medium, aiming to solve the technical problems of low efficiency and high power consumption due to untimely adjustment of a host in a central air conditioner.

In order to achieve the above objective, the present disclosure provides an air conditioner control method, applied in a central air conditioner. The air conditioner control method includes the following steps:

- acquiring a predicted load of the central air conditioner at the current moment, when a startup instruction or a shutdown instruction corresponding to an indoor unit in the central air conditioner is detected;
- determining whether the predicted load meets a change condition for an outdoor unit; and
- adjusting an operating status of the outdoor unit in the central air conditioner on a basis of the predicted load, if the predicted load meets the change condition for the outdoor unit.

In some embodiments, the step of acquiring a predicted load of the central air conditioner at the current moment includes:

- acquiring an operation parameter corresponding to an indoor unit that is currently in a startup status in the central air conditioner, and
- acquiring the predicted load on a basis of the operation parameter.

In some embodiments, the operation parameter includes a rated cooling capacity of the indoor unit, and the step of acquiring the predicted load on a basis of the operation parameter includes:

- determining a first total cooling capacity corresponding to the indoor units that are currently in the startup status on a basis of the operation parameter;
- acquiring a second gross cooling capacity of all indoor units in the central air conditioner;
- determining a terminal startup ratio on a basis the first total cooling capacity and the second gross cooling capacity; and
- determining the predicted load on a basis the terminal startup ratio and a preset gross load corresponding to the central air conditioner.

In some embodiments, the step of determining whether the predicted load meets a change condition for an outdoor unit includes:

- acquiring a total load corresponding to outdoor units that are in a startup status in the central air conditioner and a preset gross load corresponding to all outdoor units in the central air conditioner;
- calculating a load difference between the predicted load and the total load, and calculating a ratio of the load difference to the preset gross load; and
- determining whether the ratio is greater than a preset value, wherein it is determined that the predicted load meets the change condition for the outdoor unit when the ratio is greater than the preset value.

In some embodiments, the step of adjusting an operating status of the outdoor unit in the central air conditioner on a basis of the predicted load includes:

- determining an efficient outdoor unit combination on a basis of the predicted load; and
- adjusting the operating status of the outdoor unit in the central air conditioner on the basis of the efficient outdoor unit combination.

In some embodiments, the step of adjusting the operating status of the outdoor unit in the central air conditioner on the basis of the efficient outdoor unit combination includes:

- starting a first outdoor unit, if there is the first outdoor unit being in a shutdown status in the efficient outdoor unit combination; and shutting down a second outdoor unit, if there is the second outdoor unit, which does not belong to the efficient outdoor unit combination, in the outdoor units that are in the startup status in the central air conditioner.

In some embodiments, after the step of adjusting the operating status of the outdoor unit in the central air conditioner on the basis of the efficient outdoor unit combination, the air conditioner control method further includes:

controlling a valve and a water pump in the central air conditioner on a basis of the efficient outdoor unit combination.

In some embodiments, after the step of adjusting an operating status of the outdoor unit in the central air conditioner on a basis of the predicted load, the air conditioner control method further includes:

determining an efficient cooling tower combination on a basis of the predicted load; and adjusting an operating status of a cooling tower in the central air conditioner on a basis of the cooling tower combination.

Besides, in order to achieve the above objective, the present disclosure provides an air conditioner control device, applied in a central air conditioner. The air conditioner control device includes: a memory, a processor, and an air conditioner control program stored in the memory and executable by the processor, wherein the air conditioner control program when executed by the processor implements steps of an air conditioner control method as described above.

In addition, in order to achieve the above objective, the present disclosure provides a computer readable storage medium having stored therein an air conditioner control program that, when executed by a processor, implements steps of an air conditioner control method as described above.

The present disclosure acquires the predicted load of the central air conditioner at the current moment, when the startup instruction or the shutdown instruction corresponding to the indoor unit in the central air conditioner is detected; determines whether the predicted load meets the change condition for the outdoor unit; and adjusts the operating status of the outdoor unit in the central air conditioner on the basis of the predicted load, if the predicted load meets the change condition for the outdoor unit, such that the host in the central air conditioner can be timely adjusted according to the predicted load, thereby maximizing energy saving under the premise of satisfying comfortability, reducing power consumption of the central air conditioner, improving stability and speed of control of the central air conditioner, and providing the most efficient cooling supply under different load demands by timely adjusting the outdoor unit.

The implementation, functional characteristics and advantages of the objective of the present disclosure will be further illustrated in conjunction with the embodiments and with reference to the accompanying drawings.

DETAILED DESCRIPTION

It should be understood that the specific embodiments described here only intend to explain the present disclosure, but are not construed to limit the present disclosure.

Figure 1:
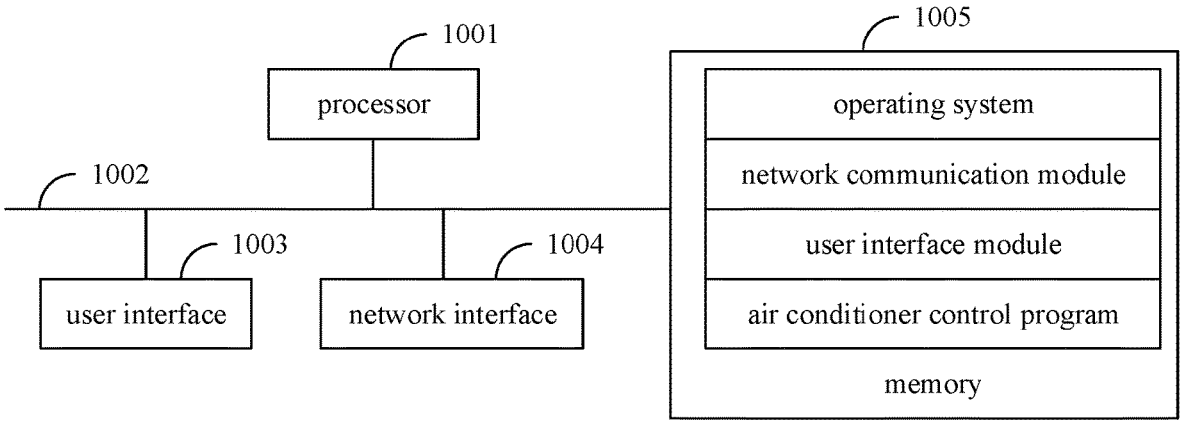
FIG. 1 is a schematic structural diagram showing an air conditioner control device in a hardware operating environment according to some embodiments of the present disclosure.

As shown in FIG. 1, FIG. 1 is a schematic structural diagram showing an air conditioner control device in a hardware operating environment according to some embodiments of the present disclosure.

As shown in FIG. 1, the air conditioner control device may include: a processor 1001 (for example, a central processor unit, CPU), a network interface 1004, a user interface 1003, a memory 1005, and a communication bus 1002. The communication bus 1002 is configured to implement connection communication between these components. The user interface 1003 may include a display, an input unit like a keyboard. The user interface 1003 may alternatively include a standard wired interface and wireless interface. The network interface 1004 may include a standard wired interface and wireless interface (such as a wireless fidelity (Wi-Fi) interface). The memory 1005 may be a high-speed random-access memory (RAM), or a non-volatile memory, such as a magnetic disk memory. The memory 1005 may also be a storage device independent of the aforementioned processor 1001.

In some embodiments, the air conditioner control device may also include a camera, a radio frequency (RF) circuit, a sensor, an audio circuit, a Wi-Fi module, and so on.

Those skilled in the art can understand that the structure of the air conditioner control device shown in FIG. 1 does not construe to limit the air conditioner control device, but may include more or fewer components than those shown in the FIG. 1, or a combination of certain components, or different configuration of the components.

As shown in FIG. 1, as a computer storage medium, the memory 1005 may include an operating system, a network communication module, a user interface module, and an air conditioner control program.

In the air conditioner control device shown in FIG. 1, the network interface 1004 is mainly used to connect to a back-end server and communicate with the back-end server; the user interface 1003 is mainly used to connect to a client-side (a user-side) and communicate with the client-side; and the processor 1001 may be used to call the air conditioner control program stored in the memory 1005.

In these embodiments, the air conditioner control device includes: a memory 1005, a processor 1001, and an air conditioner control program stored in the memory 1005 and executable by the processor 1001. The processor 1001 calls the air conditioner control program stored in the memory 1005 to implement the following steps:

acquiring a predicted load of the central air conditioner at the current moment, when a startup instruction or a shutdown instruction corresponding to an indoor unit in the central air conditioner is detected;

determining whether the predicted load meets a change condition for an outdoor unit; and adjusting an operating status of the outdoor unit in the central air conditioner on a basis of the predicted load, if the predicted load meets the change condition for the outdoor unit.

In some examples, the processor 1001 may call the air conditioner control program stored in the memory 1005 to implement the following steps:

acquiring an operation parameter corresponding to an indoor unit that is currently in a startup status in the central air conditioner; and acquiring the predicted load on a basis of the operation parameter.

In some examples, the processor 1001 may call the air conditioner control program stored in the memory 1005 to implement the following steps:

determining a first total cooling capacity corresponding to the indoor units that are currently in the startup status on a basis of the operation parameter;

acquiring a second gross cooling capacity of all indoor units in the central air conditioner;

determining a terminal startup ratio on a basis the first total cooling capacity and the second gross cooling capacity; and determining the predicted load on a basis the terminal startup ratio and a preset gross load corresponding to the central air conditioner.

In some examples, the processor 1001 may call the air conditioner control program stored in the memory 1005 to implement the following steps:

acquiring a total load corresponding to outdoor units that are in a startup status in the central air conditioner and a preset gross load corresponding to all outdoor units in the central air conditioner;

calculating a load difference between the predicted load and the total load, and calculating a ratio of the load difference to the preset gross load; and determining whether the ratio is greater than a preset value, wherein it is determined that the predicted load meets the change condition for the outdoor unit when the ratio is greater than the preset value.

In some examples, the processor 1001 may call the air conditioner control program stored in the memory 1005 to implement the following steps:

determining an efficient outdoor unit combination on a basis of the predicted load; and adjusting the operating status of the outdoor unit in the central air conditioner on the basis of the efficient outdoor unit combination.

In some examples, the processor 1001 may call the air conditioner control program stored in the memory 1005 to implement the following steps:

starting a first outdoor unit, if there is the first outdoor unit being in a shutdown status in the efficient outdoor unit combination; and shutting down a second outdoor unit, if there is the second outdoor unit, which does not belong to the efficient outdoor unit combination, in the outdoor units that are in the startup status in the central air conditioner.

In some examples, the processor 1001 may call the air conditioner control program stored in the memory 1005 to implement the following steps:

controlling a valve and a water pump in the central air conditioner on a basis of the efficient outdoor unit combination.

In some examples, the processor 1001 may call the air conditioner control program stored in the memory 1005 to implement the following steps:

determining an efficient cooling tower combination on a basis of the predicted load; and adjusting an operating status of a cooling tower in the central air conditioner on a basis of the cooling tower combination.

Figure 2:
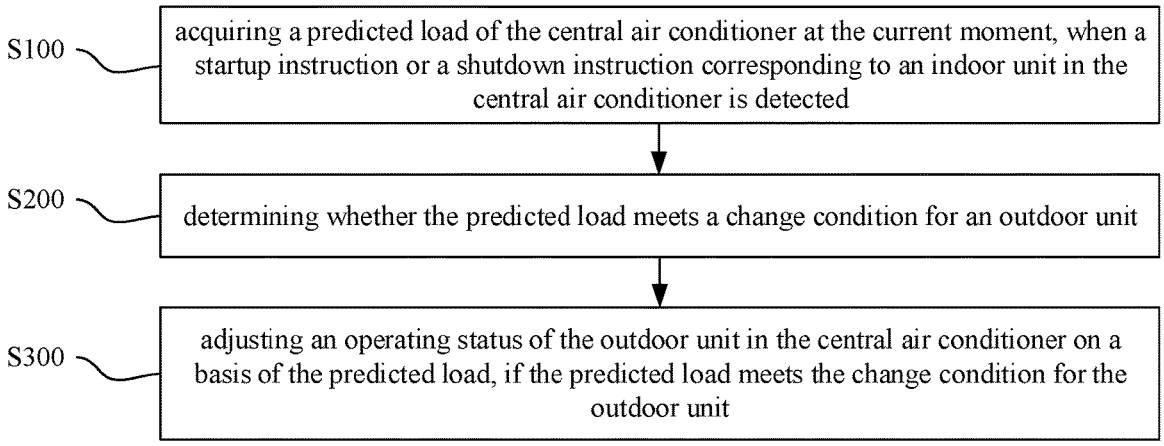
FIG. 2 is a flow chart showing an air conditioner control method according to some first embodiments of the present disclosure.

The present disclosure further provides an air conditioner control method, referring to FIG. 2, which is a flow chart showing an air conditioner control method according to some first embodiments of the present disclosure.

In these embodiments, the air conditioner control method is applied in a central air conditioner and includes the following steps of S100 to S300.

At the step of S100, when a startup instruction or a shutdown instruction corresponding to an indoor unit in the central air conditioner is detected, a predicted load of the central air conditioner at the current moment is acquired.

In these embodiments, the central air conditioner may be applied in office buildings, administration buildings, commercial buildings, factories and other scenarios, where overtime may exist in the office buildings and administration buildings; restaurants or movie theaters that open overnight may exist in commercial buildings; shifts for some production lines that are added in accordance with market demand may exist in factories. The central air conditioner is equipped with a plurality of hosts (outdoor units).

In these embodiments, it is monitored in real time whether there is an indoor unit with a changed operating status at the current moment, i.e., an indoor unit receiving a startup instruction to perform startup operation or an indoor unit receiving a shutdown instruction to perform shutdown. If there is the indoor unit with the changed operating status at the current moment, it is determined that the startup instruction or the shutdown instruction corresponding to the indoor unit in the central air conditioner is detected. At this moment, the predicted load of the central air conditioner at the current moment is acquired.

It should be noted that the predicted load is predicted according to a parameter of the indoor unit that is currently in the startup operation status.

At the step of S200, it is determined whether the predicted load meets a change condition for an outdoor unit.

At the step of S300, if the predicted load meets the change condition for the outdoor unit, an operating status of the outdoor unit in the central air conditioner is adjusted on a basis of the predicted load.

In these embodiments, when the predicted load is acquired, it is determined whether the predicted load meets the change condition for the outdoor unit. In specific, whether the predicted load meets the change condition for the outdoor unit may be determined according to the load of the outdoor unit that is currently in the operating status; alternatively, whether the predicted load meets the change condition for the outdoor unit is determined according to the predicted load at the current moment and the predicted load of the central air conditioner at the current moment before the startup instruction or the shutdown instruction is detected.

Subsequently, if the predicted load meets the change condition for the outdoor unit, the operating status of the outdoor unit in the central air conditioner is adjusted on the basis of the predicted load. In specific, the outdoor unit is adjusted according to the predicted load, so that a rated load of the outdoor unit matches the predicted load, thus further maximizing energy saving under the premise of satisfying comfortability, with more stable control and faster speed, thereby providing the most efficient cooling supply under different load demands.

The air conditioner control method provided in these embodiments acquires the predicted load of the central air conditioner at the current moment, when the startup instruction or the shutdown instruction corresponding to the indoor unit in the central air conditioner is detected; determines whether the predicted load meets the change condition for the outdoor unit; and adjusts the operating status of the outdoor unit in the central air conditioner on the basis of the predicted load, if the predicted load meets the change condition for the outdoor unit, such that the host in the central air conditioner can be timely adjusted according to the predicted load, thereby maximizing energy saving under the premise of satisfying comfortability, reducing power consumption of the central air conditioner, improving stability and speed of control of the central air conditioner, and providing the most efficient cooling supply under different load demands by timely adjusting the outdoor unit.

Based on the first embodiments, there is provided some second embodiments of the air conditioner control method according to the present disclosure. In these embodiments, the step of S100 includes steps of S110 to S120.

At the step of S110, an operation parameter corresponding to an indoor unit that is currently in a startup status in the central air conditioner is acquired.

At the step of S120, the predicted load is acquired on a basis of the operation parameter.

In these embodiments, it is monitored in real time whether there is an indoor unit with a changed operating status at the current moment, i.e., an indoor unit receiving a startup instruction to perform startup operation or an indoor unit receiving a shutdown instruction to perform shutdown. If there is the indoor unit with the changed operating status at the current moment, the indoor unit that is currently in the startup status in the central air conditioner is firstly determined, where the indoor unit that is in the startup status does not include the indoor unit receiving the shutdown instruction; the operation parameter corresponding to the indoor unit that is in the startup status is then acquired; and the predicted load is determined on the basis of the operation parameter, thereby accurately obtaining the predicted load according to the operation parameter corresponding to the indoor unit that is in the startup status.

The air conditioner control method provided by the these embodiments acquires the operation parameter corresponding to the indoor unit that is currently in the startup status in the central air conditioner; and acquires the predicted load on the basis of the operation parameter, thereby accurately obtaining the predicted load according to the operation parameter corresponding to the indoor unit that is in the startup status, thus improving the accuracy of adjusting the operating status of the outdoor unit in the central air conditioner, further reducing power consumption of the central air conditioner, and improving stability and speed of control of the central air conditioner.

Based on the second embodiments, there is provided some third embodiments of the air conditioner control method according to the present disclosure. In these embodiments, the step of S120 includes steps of S121 to S124.

At the step of S121, a first total cooling capacity corresponding to the indoor units that are currently in the startup status is determined on a basis of the operation parameter.

At the step of S122, a second gross cooling capacity of all indoor units in the central air conditioner is acquired.

At the step of S123, a terminal startup ratio is determined on a basis of the first total cooling capacity and the second gross cooling capacity.

At the step of S124, the predicted load is determined on a basis of the terminal startup ratio and a preset gross load corresponding to the central air conditioner.

In these embodiments, when the operation parameter corresponding to the indoor unit that is in the startup status is acquired, the first total cooling capacity corresponding to the indoor units that are currently in the startup status is determined on the basis of the operation parameter, where the first total cooling capacity is a sum of rated cooling capacities of individual indoor units that are in the startup status; and then the second gross cooling capacity of all indoor units in the central air conditioner is acquired, where the second gross cooling capacity is a sum of rated cooling capacities of all indoor units in the central air conditioner.

Next, the terminal startup ratio is determined on the basis of the first total cooling capacity and the second gross cooling capacity. The terminal startup ratio equals to the first total cooling capacity/the second gross cooling capacity. In other embodiments, if individual rated cooling capacities of all terminals (i.e., all indoor units in the central air conditioner) are substantially identical, the terminal startup ratio equals to the number of the indoor units that are in the startup status/the number of all indoor units in the central air conditioner.

Subsequently, the predicted load is determined on the basis of the terminal startup ratio and the preset gross load corresponding to the central air conditioner. The preset gross load is a load of the central air conditioner obtained through historical big data when almost all terminals are in the startup status during normal working hours. The predicted load equals to the terminal startup ratio * the preset gross load.

The air conditioner control method provided in these embodiments determines the first total cooling capacity corresponding to the indoor units that are currently in the startup status on the basis of the operation parameter; acquires the second gross cooling capacity of all indoor units in the central air conditioner; determines the terminal startup ratio on the basis the first total cooling capacity and the second gross cooling capacity; and determines the predicted load on the basis the terminal startup ratio and the preset gross load corresponding to the central air conditioner, thereby accurately obtaining the predicted load according to the cooling capacity corresponding to the indoor unit that is in the startup status, thus improving the accuracy of adjusting the operating status of the outdoor unit in the central air conditioner, further reducing power consumption of the central air conditioner, and improving stability and speed of control of the central air conditioner.

Based on the first embodiments, there is provided some fourth embodiments of the air conditioner control method according to the present disclosure. In these embodiments, the step of S200 includes steps of S210 to S230.

At the step of S210, a total load corresponding to outdoor units that are in the startup status in the central air conditioner and a preset gross load corresponding to all outdoor units in the central air conditioner are acquired.

At the step of S220, a load difference between the predicted load and the total load is calculated, and a ratio of the load difference to the preset gross load is also calculated.

At the step of S230, it is determined whether the ratio is greater than a preset value. When the ratio is greater than the preset value, it is determined that the predicted load meets the change condition for the outdoor unit.

In these embodiments, the total load corresponding to the outdoor units that are in the startup status in the central air conditioner and the preset gross load corresponding to all outdoor units in the central air conditioner are acquired, where the total load is a sum of loads of the outdoor units that are in the startup status, and the preset gross load is a load of the central air conditioner obtained through historical big data when almost all terminals are in the startup status during normal working hours.

Subsequently, the load difference between the predicted load and the total load is calculated, and the ratio of the load difference to the preset gross load is also calculated; it is determined whether the ratio is greater than the preset value; and it is determined that the predicted load meets the change condition for the outdoor unit when the ratio is greater than the preset value. The preset value may be set reasonably.

It would be understood that, when the preset value is 20%, in an overtime scenario, when the terminal startup ratio is switched to the overtime scenario from the normal working hour scenario, the predicted load may be reduced from 100% of the preset gross load to 10% of the preset gross load, where the ratio is 90%, such that the predicted load meets the change condition for the outdoor unit. At this time, the central air conditioner can be switched from a combination to provide maximum cooling capacity to a combination to provide minimum cooling capacity rapidly, thus achieving effect of precise cooling supply in one step.

The air conditioner control method provided in these embodiments acquires the total load corresponding to the outdoor units that are in the startup status in the central air conditioner and the preset gross load corresponding to all outdoor units in the central air conditioner; calculates the load difference between the predicted load and the total load, and calculates the ratio of the load difference to the preset gross load; and determines whether the ratio is greater than the preset value, wherein it is determined that the predicted load meets the change condition for the outdoor unit when the ratio is greater than the preset value, such that whether the predicted load meets the change condition for the outdoor unit is accurately determined according to the load of the outdoor unit, thereby improving the accuracy of adjusting the operating status of the outdoor unit, further reducing power consumption of the central air conditioner, and improving stability and speed of control of the central air conditioner.

Based on the first embodiments, there is provided some fifth embodiments of the air conditioner control method according to the present disclosure. In these embodiments, the step of S300 includes steps of S310 to S320.

At the step of S310, an efficient outdoor unit combination is determined on a basis of the predicted load.

At the step of S320, the operating status of the outdoor unit in the central air conditioner is adjusted on a basis of the efficient outdoor unit combination.

In these embodiments, when the predicted load meets the change condition for the outdoor unit, the efficient outdoor unit combination is determined on the basis of the predicted load, where the total load of all outdoor units in the efficient outdoor unit combination is greater than the predicted load. In specific, a range of the total load of all outdoor units in the efficient outdoor unit combination may be set between the predicted load*1.2 and the predicted load*1.5. Subsequently, the operating status of the outdoor unit in the central air conditioner is adjusted on the basis of the efficient outdoor unit combination, thereby accurately adjusting the operating status of the outdoor unit.

In some embodiments, the step of S320 includes steps of a and b.

At the step of a, if there is a first outdoor unit being in the shutdown status in the efficient outdoor unit combination, the first outdoor unit is started.

At the step of b, if there is a second outdoor unit, which does not belong to the efficient outdoor unit combination, in the outdoor units that are in the startup status in the central air conditioner, the second outdoor unit is shut down.

In these embodiments, the first outdoor unit that is in the shutdown status in the efficient outdoor unit combination is started; and the second outdoor unit, which does not belong to the efficient outdoor unit combination, in the outdoor units that are in the startup status in the central air conditioner is shut down, thereby accurately adjusting the operating status of the outdoor unit.

In other embodiments, after the step of S320, the air conditioner control method further includes: controlling a valve and a water pump in the central air conditioner on a basis of the efficient outdoor unit combination.

The valve and the water pump in the central air conditioner are adjusted, thus accurately adjusting a refrigerant system corresponding to the outdoor unit, thereby improving the accuracy of control of the central air conditioner.

The air conditioner control method provided in these embodiments determines the efficient outdoor unit combination on the basis of the predicted load; and adjusts the operating status of the outdoor unit in the central air conditioner on the basis of the efficient outdoor unit combination, thereby improving the accuracy of adjusting the operating status of the outdoor unit according to the efficient outdoor unit combination, further reducing power consumption of the central air conditioner, and improving stability and speed of control of the central air conditioner.

Based on the above embodiments, there is provided some sixth embodiments of the air conditioner control method according of the present disclosure. In these embodiments, after the step of S300, the air conditioner control method further includes steps of S400 to S500.

At the step of S400, an efficient cooling tower combination is determined on a basis of the predicted load.

At the step of S500, an operating status of the cooling tower in the central air conditioner is adjusted on a basis of the cooling tower combination In these embodiments, the efficient cooling tower combination is determined on the basis of a refrigerant flow range corresponding to the predicted load, and the operating status of the cooling tower in the central air conditioner is adjusted on the basis of the cooling tower combination, so that the refrigerant flow that can be cooled by the efficient cooling tower combination matches the predicted load, thereby improving the accuracy of control of the central air conditioner.

The air conditioner control method provided in these embodiments determines the efficient cooling tower combination on the basis of the predicted load; and adjusts the operating status of the cooling tower in the central air conditioner on the basis of the cooling tower combination, thus further improving the accuracy of control of the central air conditioner.

In addition, the present disclosure provides in embodiments a computer readable storage medium having stored therein an air conditioner control program that, when executed by a processor, implements the following steps:

acquiring a predicted load of the central air conditioner at the current moment, when a startup instruction or a shutdown instruction corresponding to an indoor unit in the central air conditioner is detected;

determining whether the predicted load meets a change condition for an outdoor unit; and adjusting an operating status of the outdoor unit in the central air conditioner on a basis of the predicted load, if the predicted load meets the change condition for the outdoor unit.

In some embodiments, the air conditioner control program when executed by the process implements the following step:

acquiring an operation parameter corresponding to an indoor unit that is currently in a startup status in the central air conditioner, and acquiring the predicted load on a basis of the operation parameter.

In some embodiments, the air conditioner control program when executed by the process implements the following step:

determining a first total cooling capacity corresponding to the indoor units that are currently in the startup status on a basis of the operation parameter;

acquiring a second gross cooling capacity of all indoor units in the central air conditioner;

determining a terminal startup ratio on a basis the first total cooling capacity and the second gross cooling capacity; and determining the predicted load on a basis the terminal startup ratio and a preset gross load corresponding to the central air conditioner.

In some embodiments, the air conditioner control program when executed by the process implements the following step:

acquiring a total load corresponding to outdoor units that are in a startup status in the central air conditioner and a preset gross load corresponding to all outdoor units in the central air conditioner;

calculating a load difference between the predicted load and the total load, and calculating a ratio of the load difference to the preset gross load; and determining whether the ratio is greater than a preset value, wherein it is determined that the predicted load meets the change condition for the outdoor unit when the ratio is greater than the preset value.

In some embodiments, the air conditioner control program when executed by the process implements the following step:

determining an efficient outdoor unit combination on a basis of the predicted load; and adjusting the operating status of the outdoor unit in the central air conditioner on the basis of the efficient outdoor unit combination.

In some embodiments, the air conditioner control program when executed by the process implements the following step:

starting a first outdoor unit, if there is the first outdoor unit being in a shutdown status in the efficient outdoor unit combination; and shutting down a second outdoor unit, if there is the second outdoor unit, which does not belong to the efficient outdoor unit combination, in the outdoor units that are in the startup status in the central air conditioner.

In some embodiments, the air conditioner control program when executed by the process implements the following step:

controlling a valve and a water pump in the central air conditioner on a basis of the efficient outdoor unit combination.

In some embodiments, the air conditioner control program when executed by the process implements the following step:

determining an efficient cooling tower combination on a basis of the predicted load; and adjusting an operating status of a cooling tower in the central air conditioner on a basis of the cooling tower combination.

It should be noted that the terms "comprise", "include" or any other variants thereof used herein are intended to cover non-exclusive inclusion, so that a process, method, article or system including a series of elements not only includes those specified elements, but also includes other elements that are not explicitly listed, or also includes elements inherent to the process, method, article or system. Without more restrictions, an element defined by the sentence "comprising/including a . . . " does not exclude the existence of other identical elements involved in the process, method, article or system that includes the element.

The serial numbers of the foregoing embodiments of the present disclosure are only for description, but do not represent superiority or inferiority of the embodiments.

Through the description of the above embodiments, those skilled in the art can clearly understand that the method in the above embodiments can be implemented by means of software plus the necessary general hardware platform, or by hardware, where the former is better embodiments. Based on this understanding, the technical solution of the present disclosure can be essentially or the partly that contributes to the prior art embodied in the form of a software product The computer software product is stored in a storage medium (such as ROM/RAM, magnetic disk, optical disk) as described above, including several instructions to make a terminal device (which may be a mobile phone, a computer, a server, an air conditioner, or a network device, etc.) implement the method described in individual embodiments of the present disclosure.

The above are only preferred embodiments of the present disclosure, but do not limit the scope of the present disclosure. Any equivalent structure or equivalent process transformation made based on the description and drawings of the present disclosure, or directly or indirectly used in other related technical fields, is included in the protection scope of the present disclosure for the similar reason.

What is claimed is:

1. An air conditioner control method, applied in a central air conditioner, wherein the air conditioner control method comprises:

acquiring a predicted load of the central air conditioner at a current moment when a startup instruction or a shutdown instruction corresponding to an indoor unit in the central air conditioner is detected;

determining whether the predicted load meets a change condition for an outdoor unit; and adjusting an operating status of the outdoor unit in the central air conditioner based on the predicted load if the predicted load meets the change condition for the outdoor unit, wherein determining whether the predicted load meets the change condition for the outdoor unit comprises:

acquiring a total load corresponding to outdoor units that are in startup status in the central air conditioner and a preset gross load corresponding to all outdoor units in the central air conditioner;

calculating a load difference between the predicted load and the total load, and calculating a ratio of the load difference to the preset gross load; and determining whether the ratio is greater than a preset value, wherein it is determined that the predicted load meets the change condition for the outdoor unit when the ratio is greater than the preset value.

2. The air conditioner control method according to claim 1, wherein acquiring the predicted load of the central air conditioner at the current moment comprises:

acquiring an operation parameter corresponding to the indoor unit that is currently in startup status in the central air conditioner, and acquiring the predicted load based on the operation parameter.

3. The air conditioner control method according to claim 2, wherein the operation parameter comprises a rated cooling capacity of the indoor unit, and acquiring the predicted load based on the operation parameter comprises:

determining a first total cooling capacity corresponding to indoor units that are currently in the startup status based on the operation parameter;

acquiring a second gross cooling capacity of all indoor units in the central air conditioner;

determining a terminal startup ratio based on the first total cooling capacity and the second gross cooling capacity; and determining the predicted load based on the terminal startup ratio and a preset gross load corresponding to the central air conditioner.

4. The air conditioner control method according to claim 1, wherein adjusting the operating status of the outdoor unit in the central air conditioner based on the predicted load comprises:

determining an efficient outdoor unit combination based on the predicted load; and adjusting the operating status of the outdoor unit in the central air conditioner based on the efficient outdoor unit combination.

5. The air conditioner control method according to claim 4, wherein adjusting the operating status of the outdoor unit in the central air conditioner based on the efficient outdoor unit combination comprises:

in accordance with a determination that a first outdoor unit is in shutdown status and in the efficient outdoor unit combination, starting the first outdoor unit; and in accordance with a determination that a second outdoor unit is not in the efficient outdoor unit combination and is in startup status, shutting down the second outdoor unit.

6. The air conditioner control method according to claim 4, further comprising:

controlling a valve and a water pump in the central air conditioner based on the efficient outdoor unit combination, after adjusting the operating status of the outdoor unit in the central air conditioner on a basis of based on the efficient outdoor unit combination.

7. The air conditioner control method according to claim 1, further comprising:

determining an efficient cooling tower combination based on the predicted load; and adjusting an operating status of a cooling tower in the central air conditioner based on the efficient cooling tower combination after adjusting an operating status of the outdoor unit in the central air conditioner based on the predicted load.

8. An air conditioner control device, applied in the central air conditioner, the air conditioner control device comprises: a memory, a processor, and an air conditioner control program stored in the memory and executable by the processor, wherein the air conditioner control program when executed by the processor implements the air conditioner control method according to claim 1.

9. A non-transitory computer readable storage medium having stored therein an air conditioner control program that, when executed by a processor, implements the air conditioner control method according to claim 1.

10. The air conditioner control method according to claim 3, wherein the preset gross load is a load of the central air conditioner obtained through historical big data when most terminals are in the startup status during working hours.

11. The air conditioner control method according to claim 10, wherein the predicted load is a product of the terminal startup ratio and the preset gross load.

* * * * *